US009195197B2

(12) United States Patent
Hirano

(10) Patent No.: US 9,195,197 B2
(45) Date of Patent: Nov. 24, 2015

(54) BOOKBINDING CONTROL DEVICE, NON-TRANSITORY COMPUTER READABLE MEDIUM, BOOKBINDING SYSTEM, AND METHOD OF CONTROLLING BOOKBINDING

(75) Inventor: Tomoaki Hirano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 391 days.

(21) Appl. No.: 13/564,363

(22) Filed: Aug. 1, 2012

(65) Prior Publication Data

US 2013/0236268 A1 Sep. 12, 2013

(30) Foreign Application Priority Data

Mar. 9, 2012 (JP) ..... 2012-053037

(51) Int. Cl.
*B42C 19/02* (2006.01)
*B42C 19/04* (2006.01)
*G03G 15/00* (2006.01)

(52) U.S. Cl.
CPC ..... *G03G 15/6544* (2013.01); *B42C 19/02* (2013.01); *B42C 19/04* (2013.01)

(58) Field of Classification Search
CPC .... B42C 19/02; B42C 19/04; G03G 15/6544; G03G 2215/00822; G03G 2215/00848; B41J 29/38; B65H 2301/5161; B65H 2801/48
USPC ..... 400/76; 270/58.07, 58.08, 58.09, 58.11, 270/32, 37
See application file for complete search history.

(56) References Cited

U.S. PATENT DOCUMENTS

| | | | | |
|---|---|---|---|---|
| 5,060,921 | A * | 10/1991 | Higashio et al. | 270/58.09 |
| 7,907,887 | B2 * | 3/2011 | Asai et al. | 399/407 |
| 7,983,584 | B2 * | 7/2011 | Okamoto et al. | 399/82 |
| 2006/0157909 | A1 * | 7/2006 | Terao et al. | 270/58.07 |
| 2008/0237962 | A1 | 10/2008 | Kubota et al. | |
| 2009/0097060 | A1 | 4/2009 | Okada | |
| 2009/0190167 | A1 | 7/2009 | Kanai | |

FOREIGN PATENT DOCUMENTS

| | | |
|---|---|---|
| JP | A-2009-29562 | 2/2009 |
| JP | A-2009-91131 | 4/2009 |
| JP | A-2009-172980 | 8/2009 |

* cited by examiner

*Primary Examiner* — Daniel J Colilla
*Assistant Examiner* — John M Royston
(74) *Attorney, Agent, or Firm* — Oliff PLC

(57) ABSTRACT

A bookbinding control device includes an acquisition unit that acquires print data including post-processing-not-required pages requiring no post-processing and post-processing-required pages requiring post-processing, a first accumulation controller that performs control so as to accumulate sheets with the printed post-processing-not-required pages in a first accumulation unit, and a bookbinding controller that performs control so as to perform bookbinding after the sheets with the printed post-processing-not-required pages in the first accumulation unit and the post-processing-required pages subjected to the post-processing are accumulated in an accumulation unit of a bookbinding device in a prescribed order, wherein the post-processing-not-required pages subjected to the post-processing are accumulated in a second accumulation unit different from the first accumulation unit.

6 Claims, 22 Drawing Sheets

(FIG. 7 Continued)
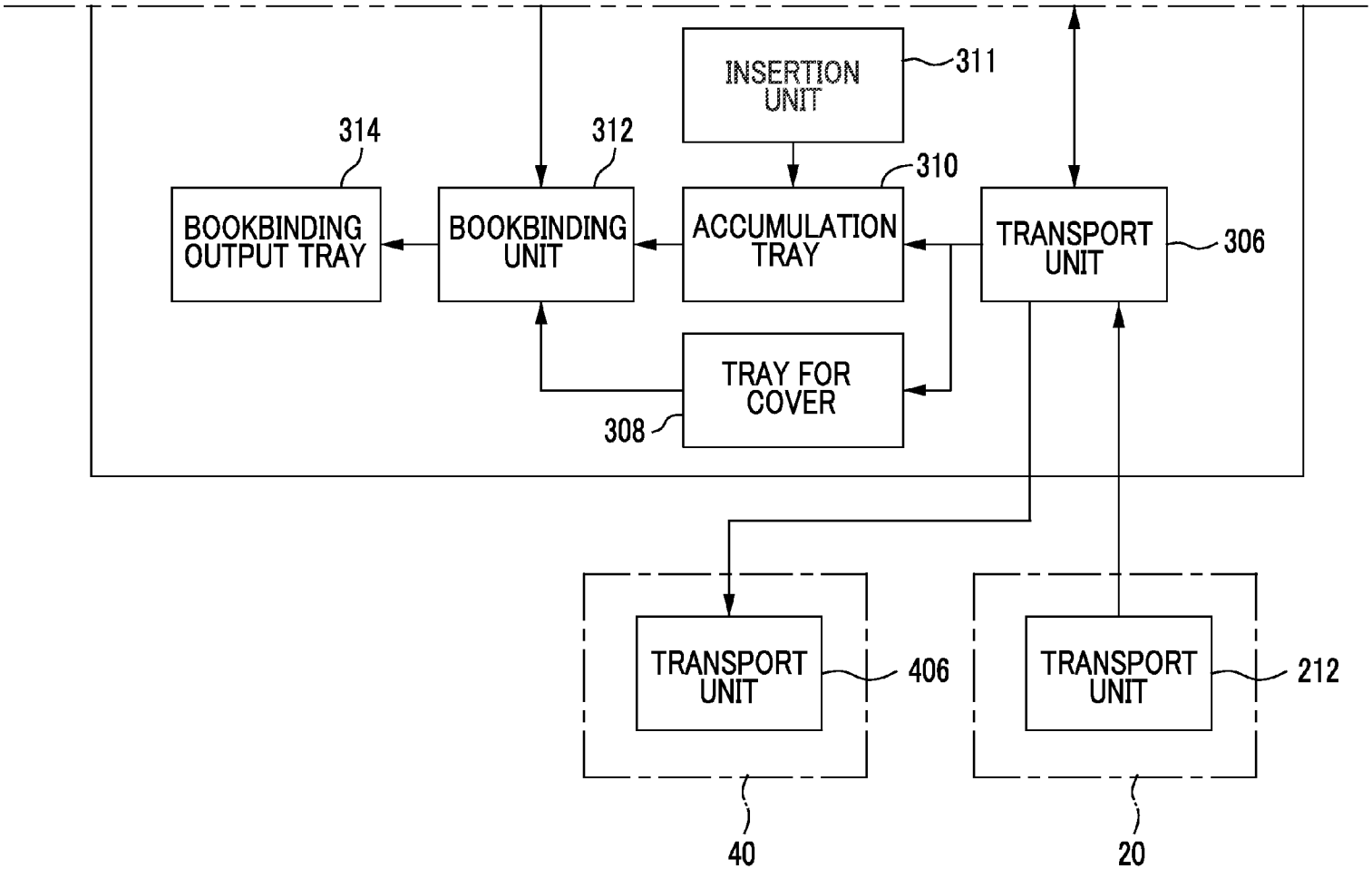

BOOKBINDING CONTROL DEVICE, NON-TRANSITORY COMPUTER READABLE MEDIUM, BOOKBINDING SYSTEM, AND METHOD OF CONTROLLING BOOKBINDING

CROSS-REFERENCE TO RELATED APPLICATIONS

This application is based on and claims priority under 35 USC 119 from Japanese Patent Application No. 2012-053037 filed Mar. 9, 2012.

BACKGROUND (i) Technical Field

The present invention relates to a bookbinding control device, a non-transitory computer readable medium, a bookbinding system, and a method of controlling bookbinding.

(ii) Related Art

Bookbinding is performed on printed matter printed by a printer. In the bookbinding of the printed matter, when sheets of different sizes are included in the printed matter, bookbinding is performed after folding (for example, Z folding) is performed such that a sheet of large size fits with a sheet of small size.

For example, when a post-processing device which performs folding is connected at the back of a bookbinding device which performs bookbinding, a sheet subjected to folding is unable to be transported to the bookbinding device.

SUMMARY

According to an aspect of the invention, there is provided a bookbinding control device including an acquisition unit that acquires print data including post-processing-not-required pages requiring no post-processing after printing and before bookbinding and post-processing-required pages requiring post-processing, a first accumulation controller that performs control so as to accumulate sheets with the printed post-processing-not-required pages based on print data in a first accumulation unit, and a bookbinding controller that performs control so as to perform bookbinding after the sheets with the printed post-processing-not-required pages in the first accumulation unit and the post-processing-required pages subjected to the post-processing based on the print data are accumulated in an accumulation unit of a bookbinding device in a prescribed order, wherein the post-processing-not-required pages subjected to the post-processing are accumulated in a second accumulation unit different from the first accumulation unit.

BRIEF DESCRIPTION OF THE DRAWINGS

Exemplary embodiments of the present invention will be described in detail based on the following figures, wherein.

DETAILED DESCRIPTION

Hereinafter, a mode (hereinafter, referred to as an exemplary embodiment) for carrying out the invention will be described with reference to the drawings.

Figure 1:
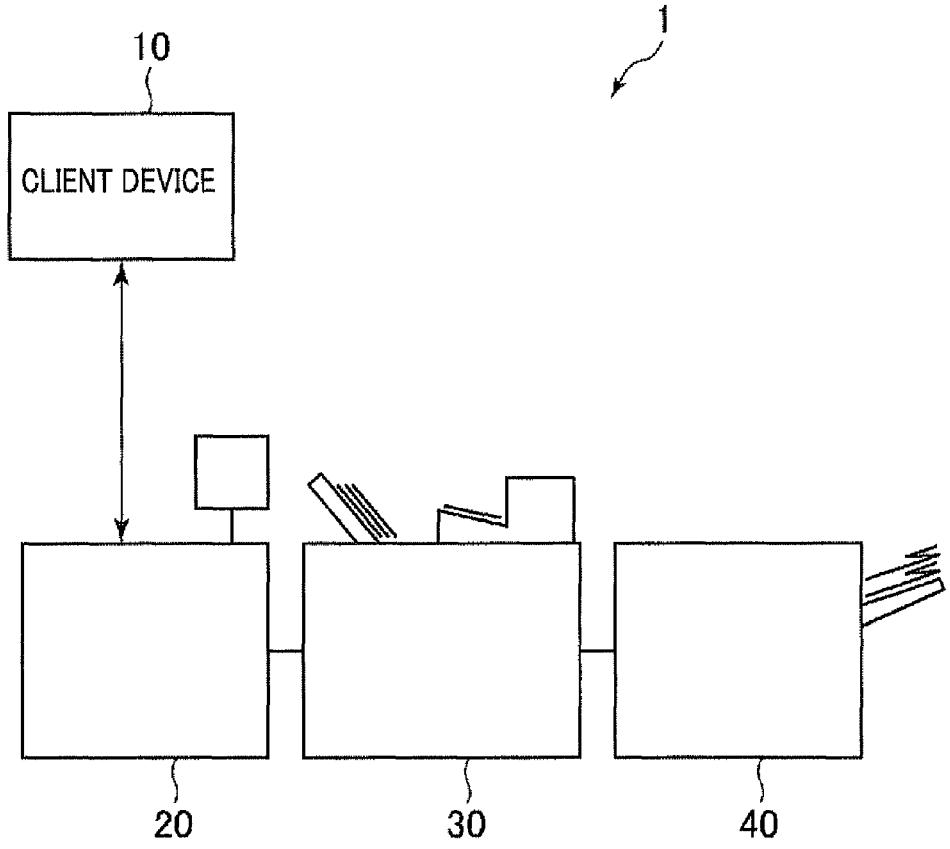
FIG. 1 is an overall configuration diagram of a bookbinding system according to this exemplary embodiment.

FIG. 1 is an overall configuration diagram of a bookbinding system 1 according to this exemplary embodiment. As shown in FIG. 1, the bookbinding system 1 includes a client device 10, a printer 20, a bookbinding device 30, and a post-processing device 40. In this exemplary embodiment, the sheet transport paths of the printer 20, the bookbinding device 30, and the post-processing device 40 are connected together in this order, and a sheet on which an image is formed (printed) by the printer 20 is transported to the bookbinding device 30 or the post-processing device 40 through the internal transport path of the bookbinding device 30.

The client device 10 is a computer which requests the printer 20 for printing. Although in this exemplary embodiment, print data with bookbinding designated is transmitted from the client device 10 toward the printer 20, data with bookbinding designated and data with no bookbinding designated may be mixed in print data.

The printer 20 controls printing and bookbinding on the basis of print data received from the client device 10. The details of printing and bookbinding will be described below.

The post-processing device 40 acquires sheets printed by the printer 20 through the internal transport path of the bookbinding device 30 and performs designated post-processing on the acquired sheets.

Figure 2:
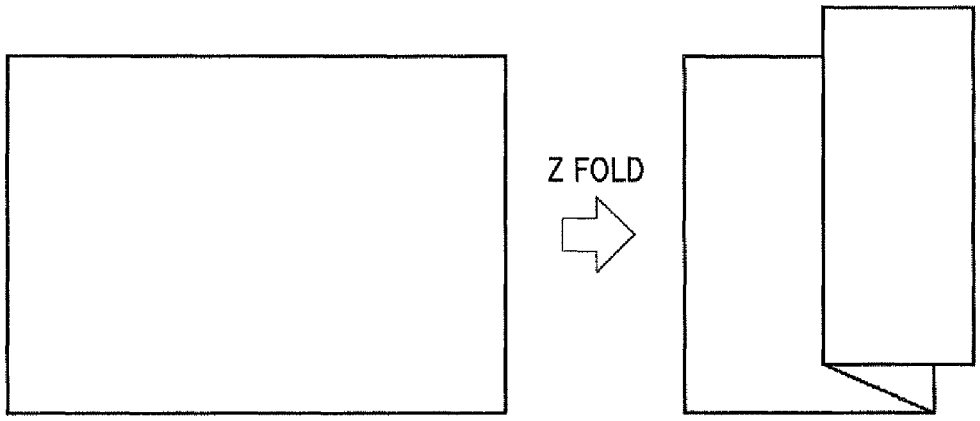
FIG. 2 is a diagram illustrating Z folding.

In this exemplary embodiment, the processing which is performed by the post-processing device 40 is folding shown in FIG. 2 which is called Z folding. Z folding refers to a folding method in which forward folding (or backward folding) of the long side of the sheet is performed, and then backward folding (or forward folding) of the forward-folded (or backward-folded) portion is performed. For example, when Z folding is performed such that the length of the long side of an A3 sheet is equal to or smaller than the length of the short side of an A4 sheet, the A3 sheet after Z folding does not protrude when overlapping the A4 sheet.

The bookbinding device 30 performs bookbinding of a sheet bundle for text including sheets printed by the printer 20 and sheets subjected to post-processing by the post-processing device 40. Hereinafter, a specific example of bookbinding in this exemplary embodiment will be described.

Figure 3:
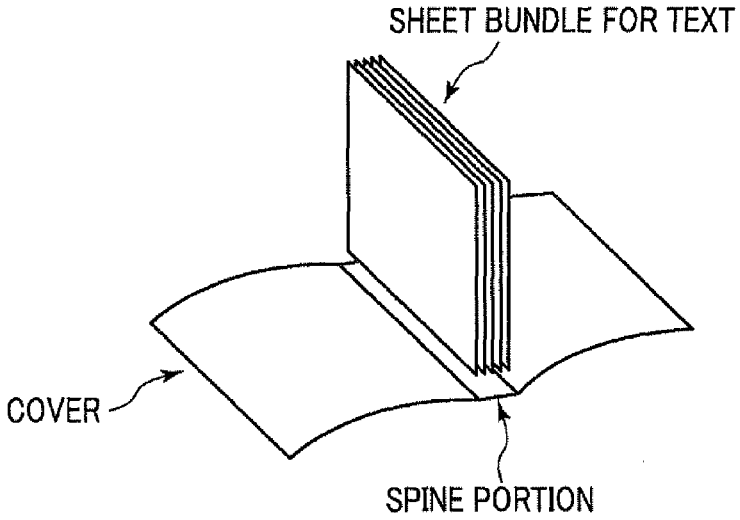
FIG. 3 is a diagram illustrating case bookbinding.

In this exemplary embodiment, the bookbinding device 30 performs bookbinding shown in FIG. 3 which is called so-called case bookbinding. Case bookbinding is a bookbinding method in which a sheet bundle for text including Z-folded pages and normal pages not subjected to Z folding arranged in a prescribed order is bonded to a cover page, a so-called case cover, with a spine portion at the center thereof. When bonding the cover page and the sheet bundle for text, an adhesive, such as paste, may be used.

The flow of bookbinding by the bookbinding device 30 will be described with reference to a schematic configuration diagram of the bookbinding device 30 shown in FIG. 4.

Figure 4:
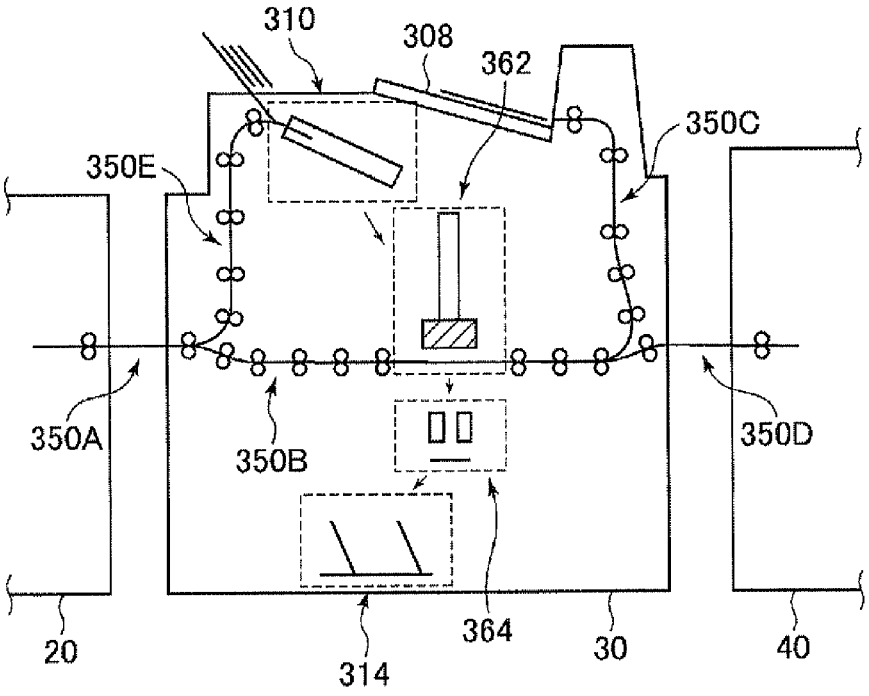
FIG. 4 is a schematic configuration diagram of a bookbinding device.

As shown in FIG. 4, the sheets printed by the printer 20 are transported toward the bookbinding device 30 through a transport path 350A. Of the sheets, the cover page is printed as a last page and transported to a pasting unit 362. Of the printed sheets, pages (post-processing-required pages) on which post-processing by the post-processing device 40 are required are output to the post-processing device 40 through the transport path 350A, a transport path 350B, and a transport path 350D. Of the printed sheets, pages (post-processing-required pages) on which post-processing is not required are output to an accumulation tray 310 through the transport path 350A and a transport path 350E.

Next, a sheet bundle for text with the post-processing-required pages and the post-processing-not-required pages are arranged in a prescribed order is disposed in the accumulation tray 310 of the bookbinding device 30. The bookbinding device 30 transports the sheet bundle for text from the accumulation tray 310 to the pasting unit 362, when a cover is printed, uses a sheet having been transported to the pasting unit 362, and when a cover is not printed, transports a cover page from a tray 308 for a cover or a paper supplying tray to the pasting unit 362. After the sheet bundle for text and the cover page are bonded in the pasting unit 362, cutting is performed using a cutting unit 364, and output to a bookbinding output tray 314 is performed.

Next, a hardware configuration example of each of the client device 10, the printer 20, the bookbinding device 30, and the post-processing device 40 will be described in order.

Figure 5:
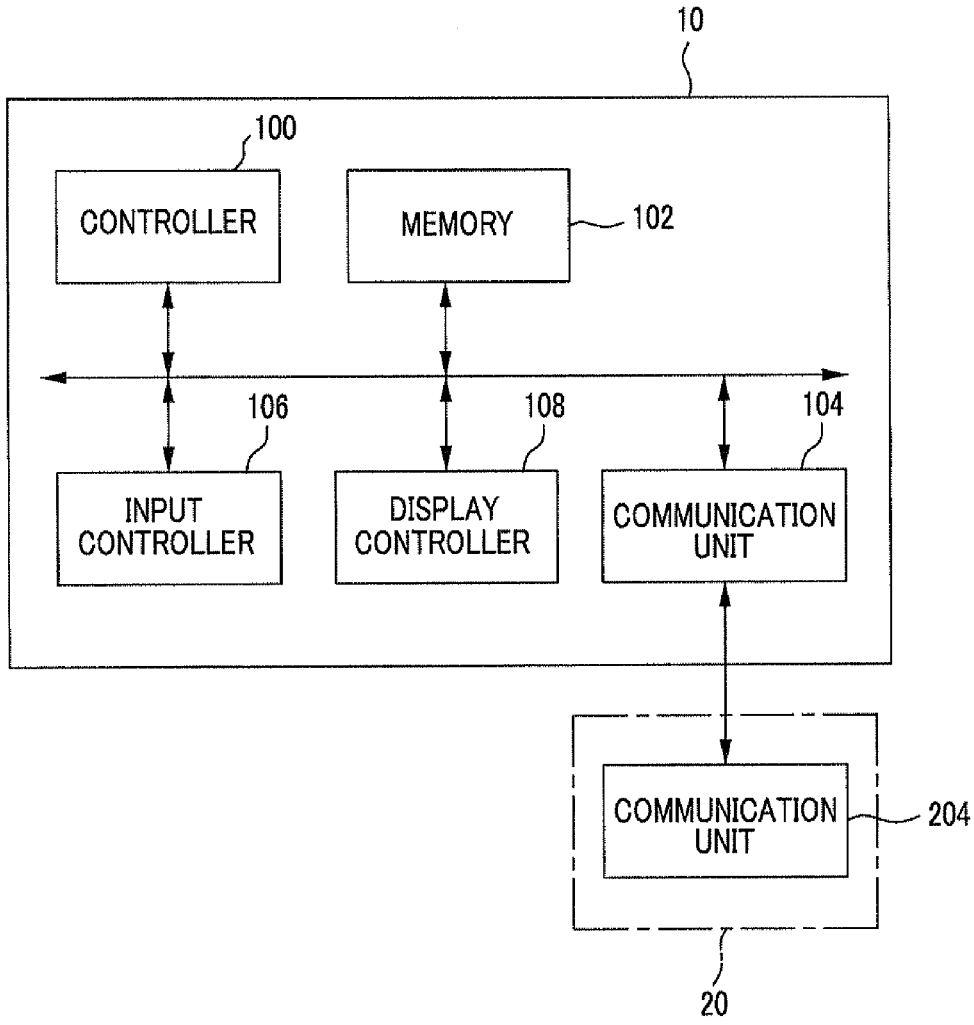
FIG. 5 is a diagram showing an example of the hardware configuration of a client device.

FIG. 5 shows an example of the hardware configuration of the client device 10. As shown in FIG. 5, the client device 10 includes a controller 100, a memory 102, a communication unit 104, an input controller 106, and a display controller 108.

The controller 100 includes a CPU (Central Processing Unit). The controller 100 performs various kinds of arithmetic processing on the basis of a program stored in the memory 102 and controls the respective units of the client device 10.

The memory 102 stores a control program, such as an operating system of the client device 10, or data, and is used as a work memory of the controller 100. A program may be supplied in a state of being stored in an information storage medium, such as an optical disc, a magnetic disk, a magnetic tape, a magnetic-optical disc, or a flash memory, to the client device 10 or may be supplied to the client device 10 through data communication means, such as Internet.

The communication unit 104 performs data communication with other devices (for example, the printer 20 and the like) using a communication interface, such as a network card or a serial communication card. In this exemplary embodiment, the communication unit 104 of the client device 10 performs data communication with a communication unit 204 of the printer 20.

The input controller 106 is connected to an input device, such as a mouse or a keyboard, and receives an operation input from a user.

The display controller 108 is embedded in the client device 10 or is connected to an external display device, such as a liquid crystal display, and performs control such that the display device displays the result (screen) of information processing in the client device 10.

Figure 6A:
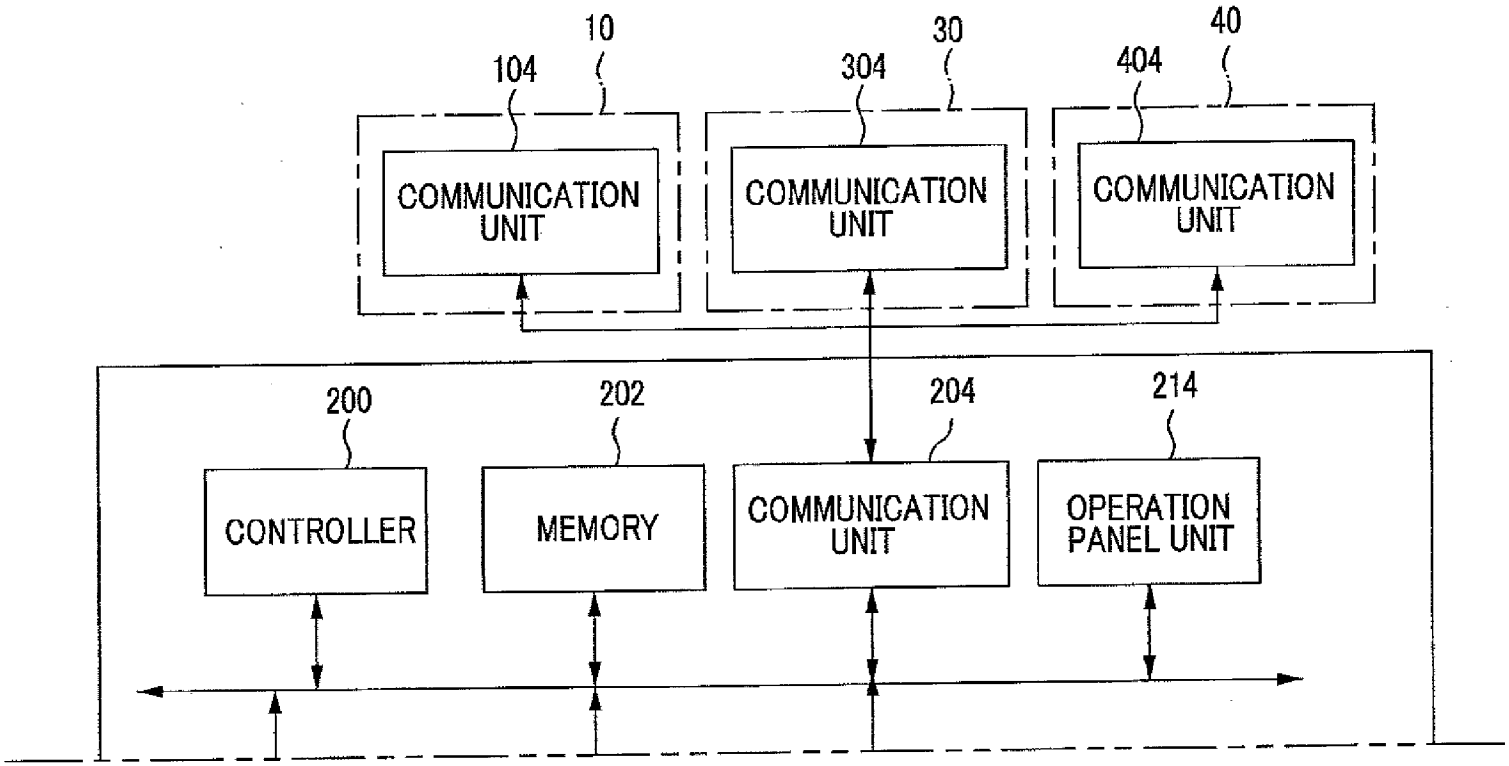
FIGS. 6(*a*) and 6(*b*) are diagrams showing an example of the hardware configuration of a printer.
Figure 6B:
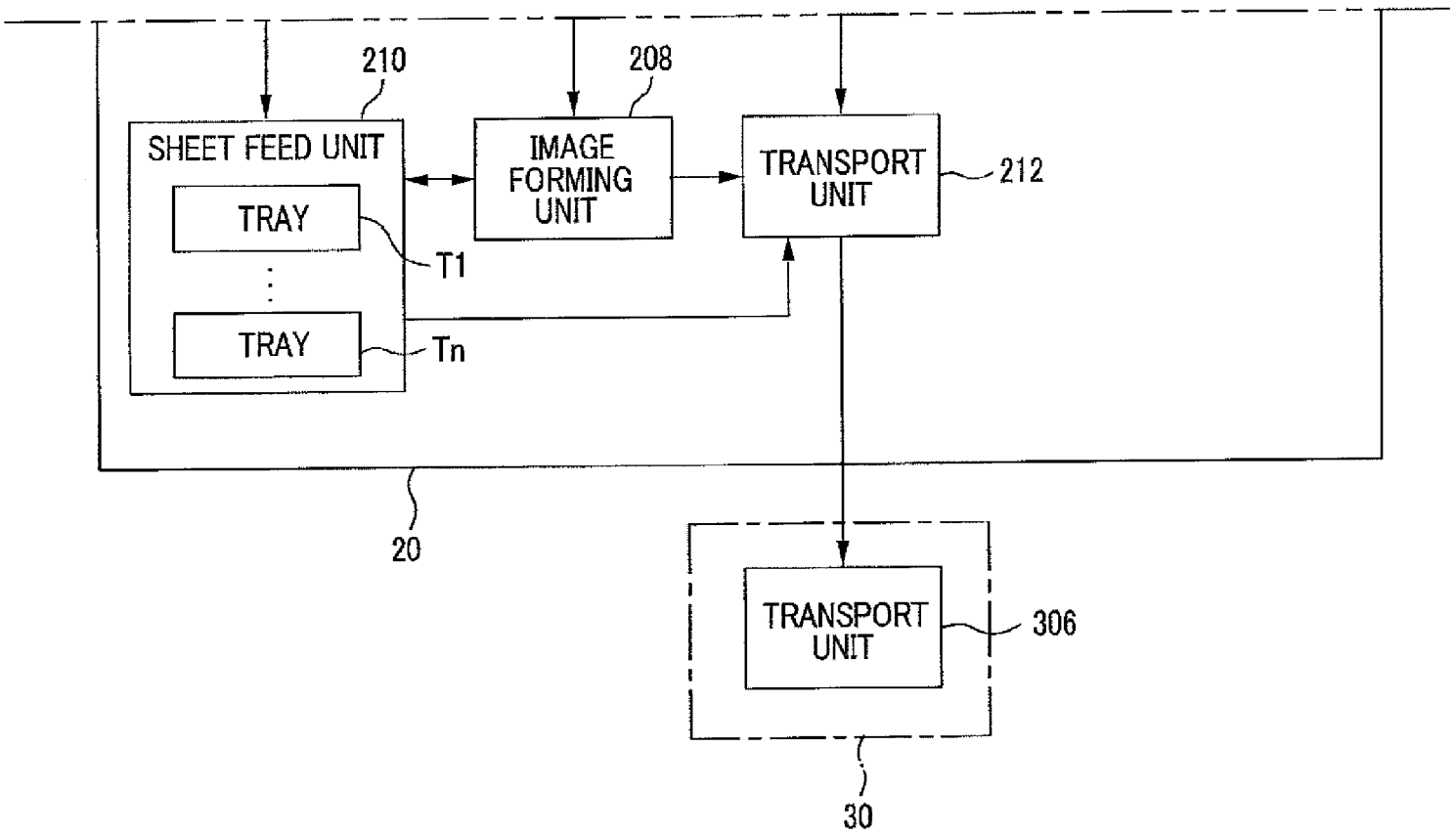

Next, the configuration of the printer 20 will be described. FIGS. 6(*a*) and 6(*b*) show an example of the hardware configuration of the printer 20. As shown in FIGS. 6(*a*) and 6(*b*), the printer 20 includes a controller 200, a memory 202, a communication unit 204, an image forming unit 208, a sheet feed unit 210, a transport unit 212, and an operation panel unit 214.

The controller 200 includes a CPU (Central Processing Unit). The controller 200 performs various kinds of arithmetic processing on the basis of a program stored in the memory 202 and controls the respective units of the printer 20.

The memory 202 stores a control program of the printer 20 or data, and is used as a work memory of the controller 200. A program may be supplied to the printer 20 in a state of being stored in an information storage medium, such as an optical disc, a magnetic disk, a magnetic tape, a magnetic-optical disc, or a flash memory, or may be supplied to the printer 20 through data communication means, such as Internet.

The communication unit 204 performs data communication with other devices (for example, the client device 10, the bookbinding device 30, the post-processing device 40, and the like) using a communication interface, such as a network card or a serial communication card. In this exemplary embodiment, the communication unit 204 of the printer 20 performs data communication with the communication unit 104 of the client device 10, a communication unit 304 of the bookbinding device 30, and a communication unit 404 of the post-processing device 40.

The image forming unit 208 forms an image on a printing medium (printing sheet) fed from the sheet feed unit 210 in accordance with an image forming command (print job) input from the controller 200. For example, the image forming unit 208 may form an image using a laser printer system or may form an image using an ink jet printer system.

The sheet feed unit 210 includes one or multiple trays T1 to Tn (where n is a natural number). The sheet feed unit 210 extracts a printing medium from a tray which stores a designated printing medium (printing sheet), and feeds the printing medium to the image forming unit 208 or the transport unit. For example, the trays T1 to Tn may include a tray for each sheet size (for example, A3, A4, or the like), a tray for colored sheets, and the like. The sheet feed unit 210 may be embedded in the printer 20 or may be provided outside the printer 20.

The transport unit 212 transports a printing sheet on which an image is formed using the image forming unit 208. For example, the transport unit 212 transports a printing medium on which an image is formed by the image forming unit 208 or transports a printing medium fed from the sheet feed unit 210. In this exemplary embodiment, the transport unit 212 of the printer 20 is connected to a transport unit 306 of the bookbinding device 30 and sends a printing medium to the transport unit 306.

The operation panel unit 214 is a display function-equipped input device which includes a display device, such as a liquid crystal display, and a button-type or touch panel-type input device. The operation panel unit 214 functions as an interactive interface with a user who operates the printer 20.

Figure 7A:
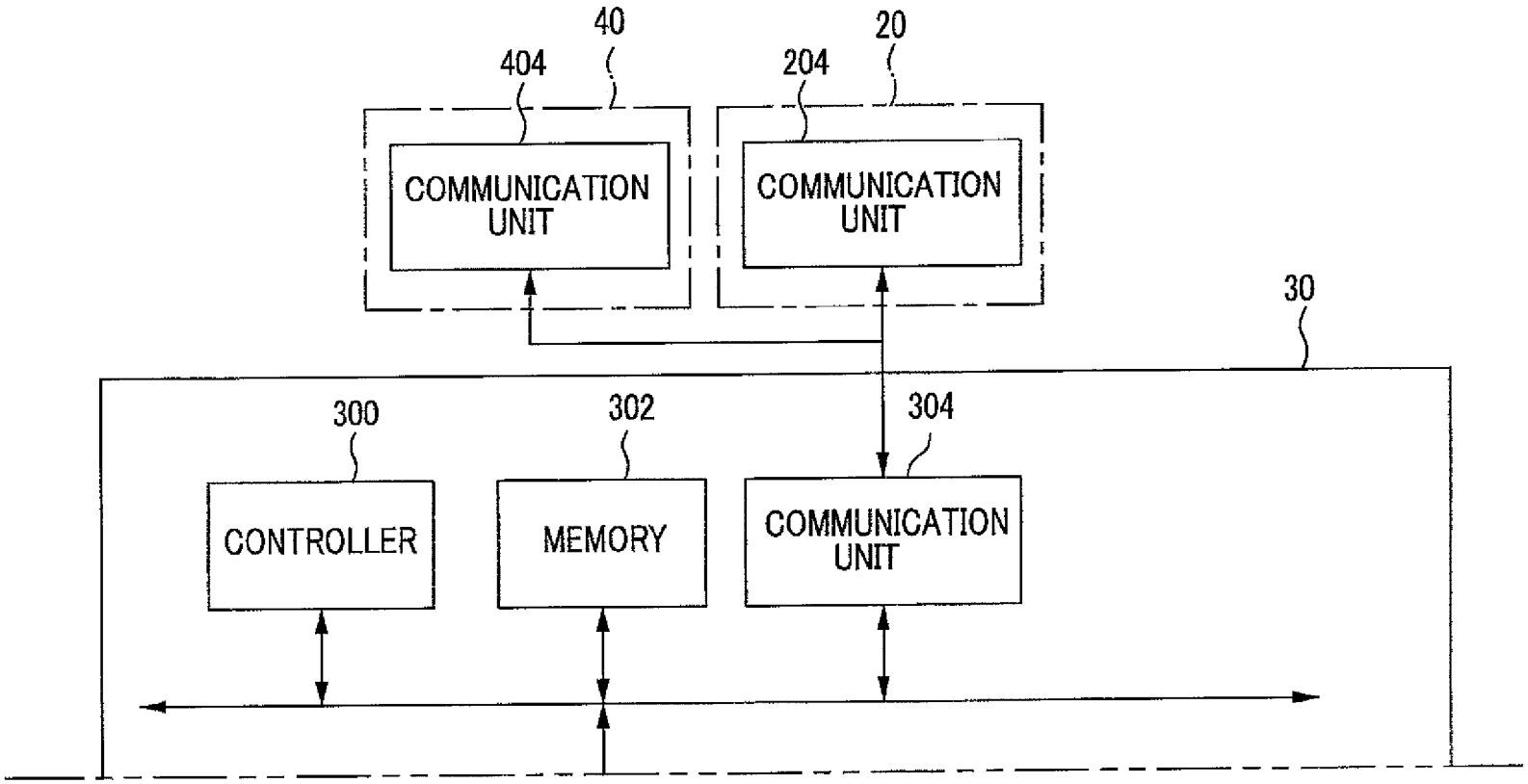
FIGS. 7(*a*) and 7(*b*) are diagrams showing an example of the hardware configuration of a bookbinding device.
Figure 7B:
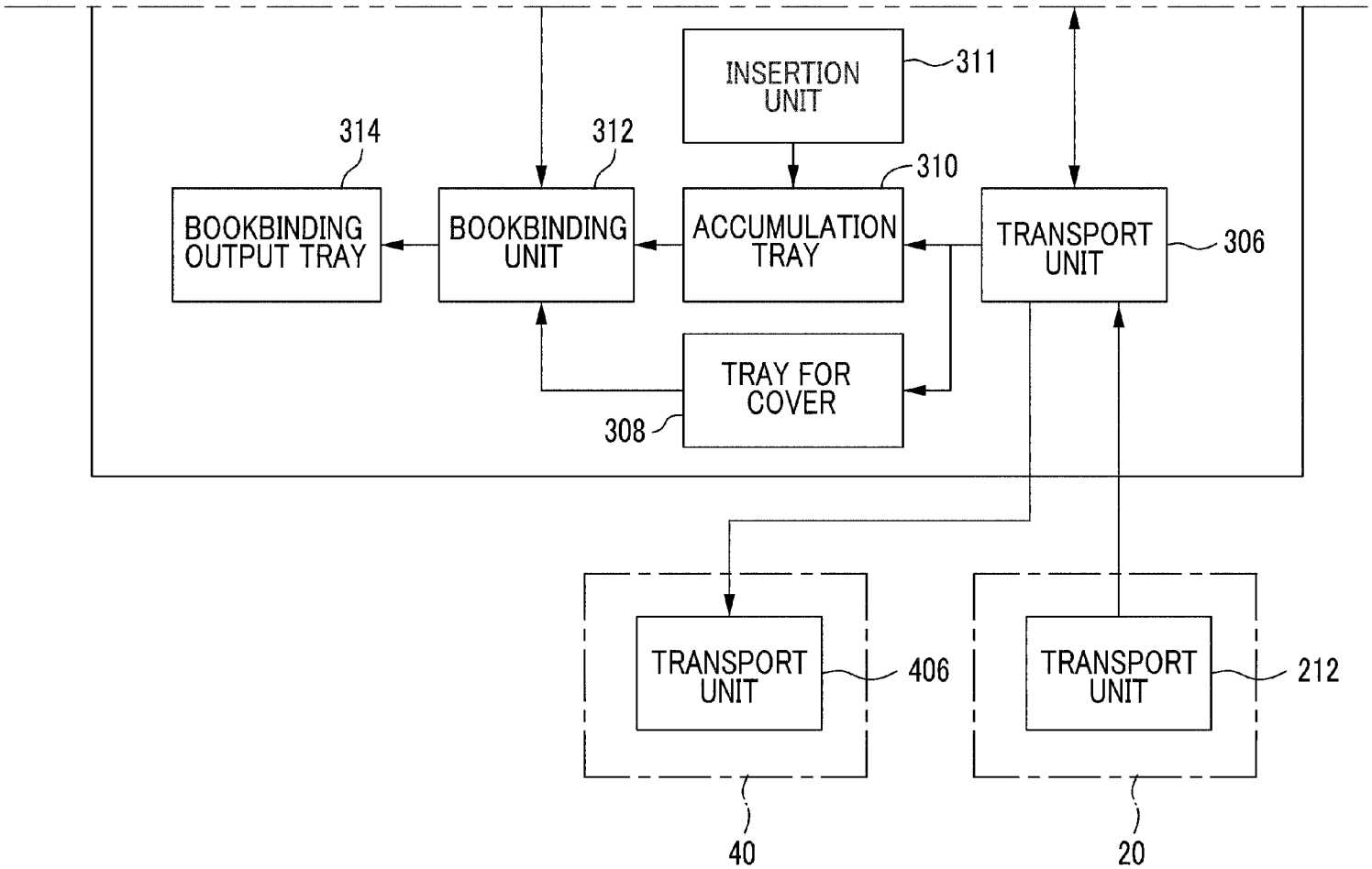

Next, the configuration of the bookbinding device 30 will be described. FIGS. 7(*a*) and 7(*b*) show an example of the hardware configuration of the bookbinding device 30. As shown in FIGS. 7(*a*) and 7(*b*), the bookbinding device 30 includes a controller 300, a memory 302, a communication unit 304, a transport unit 306, a tray 308 for a cover, an accumulation tray 310, a bookbinding unit 312, and a bookbinding output tray 314.

The controller 300 includes a CPU (Central Processing Unit). The controller 300 performs various kinds of arithmetic processing on the basis of a program stored in the memory 302 and controls the respective units of the bookbinding device 30.

The memory 302 stores a control program of the bookbinding device 30 or data, and is used as a work memory of the controller 300. A program may be supplied to the bookbinding device 30 in a state of being stored in an information storage medium, such as an optical disk, a magnetic disc, a magnetic tape, a magnetic-optical disc, or a flash memory, or may be supplied to the bookbinding device 30 through data communication means, such as Internet.

The communication unit 304 performs data communication with other devices (for example, the printer 20, the post-processing device 40, and the like) using a communication interface, such as a network card or a serial communication card. In this exemplary embodiment, the communication unit 304 of the bookbinding device 30 performs data communication with the communication unit 204 of the printer 20 or a communication unit 404 of the post-processing device 40.

The transport unit 306 transports a printing sheet transported from the printer 20 to the accumulation tray 310 of the bookbinding device 30 or to the post-processing device 40. For example, when a printing sheet transported from the printer 20 is a post-processing-not-required page, the transport unit 306 transports the printing sheet to the accumulation tray 310. When a printing sheet transported from the printer 20 is a post-processing-required page, the transport unit 306 sends the printing sheet to the post-processing device 40.

The tray 308 for a cover is a tray which supplies a medium (paper) as a cover for bookbinding.

The accumulation tray 310 is a tray which accumulates mediums (paper) as text for bookbinding.

The bookbinding unit 312 performs bookbinding with a medium supplied to the tray 308 for a cover as a cover page and mediums accumulated in the accumulation tray 310 as text (a sheet bundle for text). A specific flow of bookbinding is as described above, and thus description thereof will not be repeated.

The bookbinding output tray 314 is a tray in which a product (book) from the bookbinding unit 312 is loaded.

Figure 8:
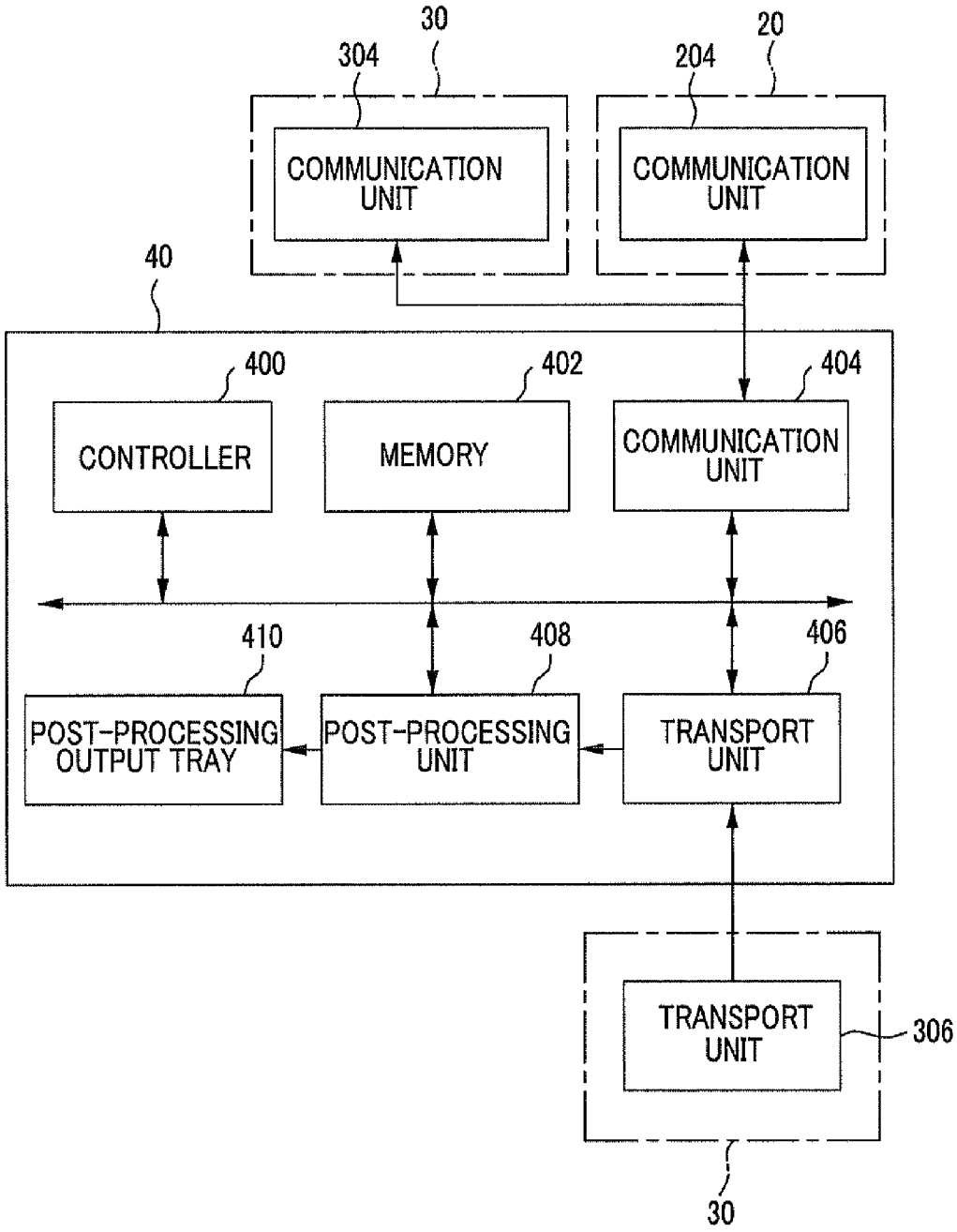
FIG. 8 is a diagram showing an example of the hardware configuration of a post-processing device.

Next, the configuration of the post-processing device 40 will be described. FIG. 8 shows an example of the hardware configuration of the post-processing device 40. As shown in FIG. 8, the post-processing device 40 includes a controller 400, a memory 402, a communication unit 404, a transport unit 406, a post-processing unit 408, and a post-processing output tray 410.

The controller 400 includes a CPU (Central Processing Unit). The controller 400 performs various kinds of arithmetic processing on the basis of a program stored in the memory 402 and controls the respective units of the post-processing device 40.

The memory 402 stores a control program of the post-processing device 40 or data, and is used as a work memory of the controller 400. A program may be supplied to the post-processing device 40 in a state of being stored in an information storage medium, such as an optical disc, a magnetic disk, a magnetic tape, a magnetic-optical disc, or a flash memory, or may be supplied to the post-processing device 40 through data communication means, such as Internet.

The communication unit 404 performs data communication with other devices (for example, the printer 20, the bookbinding device 30, and the like) using a communication interface, such as a network card or a serial communication card. In this exemplary embodiment, the communication unit 404 of the post-processing device 40 performs data communication with the communication unit 204 of the printer 20 or the communication unit 304 of the bookbinding device 30.

The transport unit 406 is connected to the transport unit 306 of the bookbinding device 30, and transports a printing sheet transported from the transport unit 306 of the bookbinding device 30 to the post-processing unit 408.

The post-processing unit 408 performs designated post-processing on a printing medium transported from the transport unit 406. In this exemplary embodiment, the post-processing unit 408 performs Z folding on the transported printing medium and discharges the printing medium after Z folding to the post-processing output tray 410.

The post-processing output tray 410 is a tray which accumulates printing mediums subjected to post-processing by the post-processing unit 408 (that is, sheets subjected to Z folding).

Next, the flow of bookbinding according to a first example in the bookbinding system 1 will be described with reference to flowcharts of FIGS. 9 and 10.

Figure 9A:
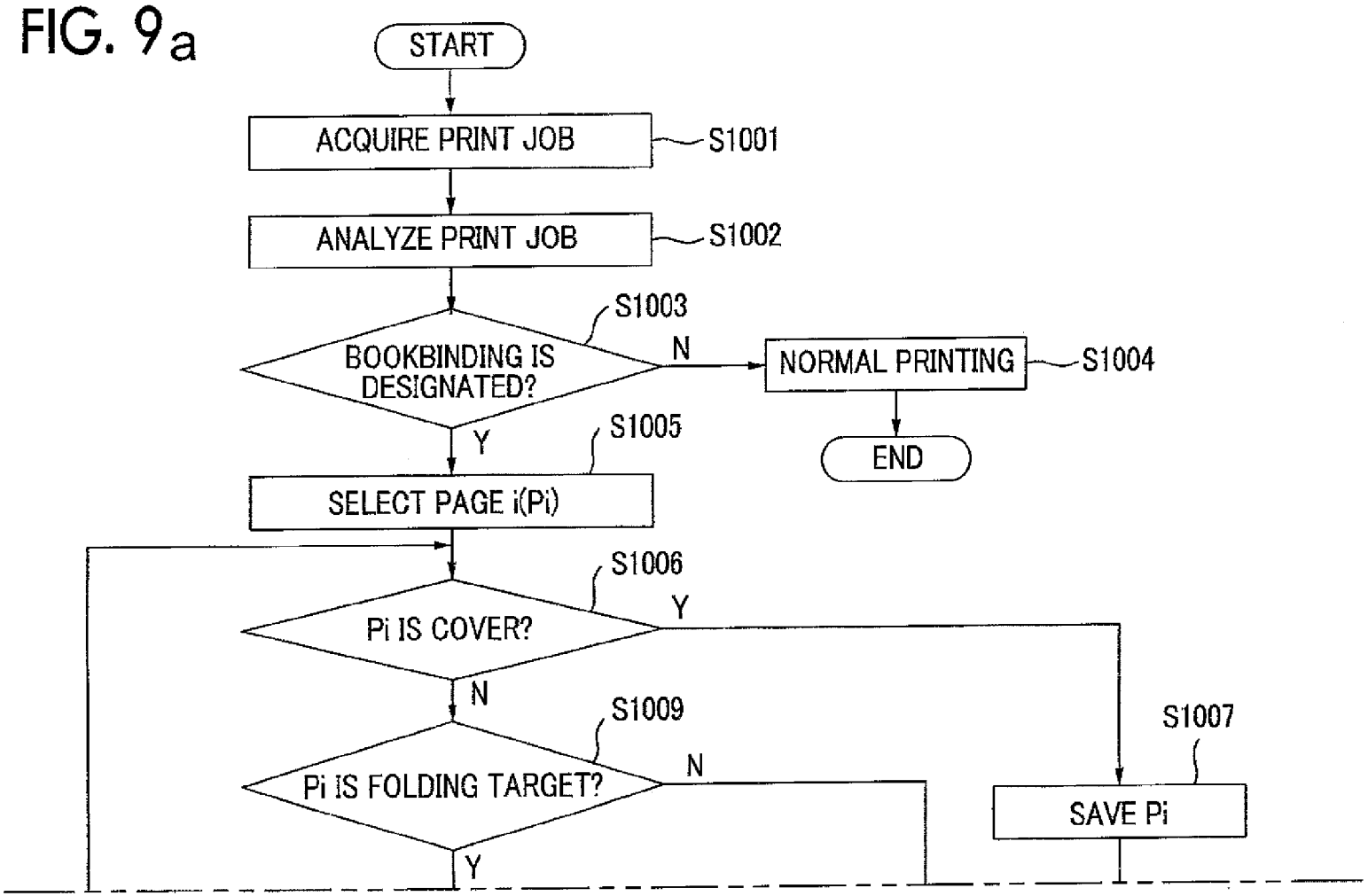
FIGS. 9(*a*) and 9(*b*) are flowcharts illustrating the flow of bookbinding according to a first example.
Figure 9B:
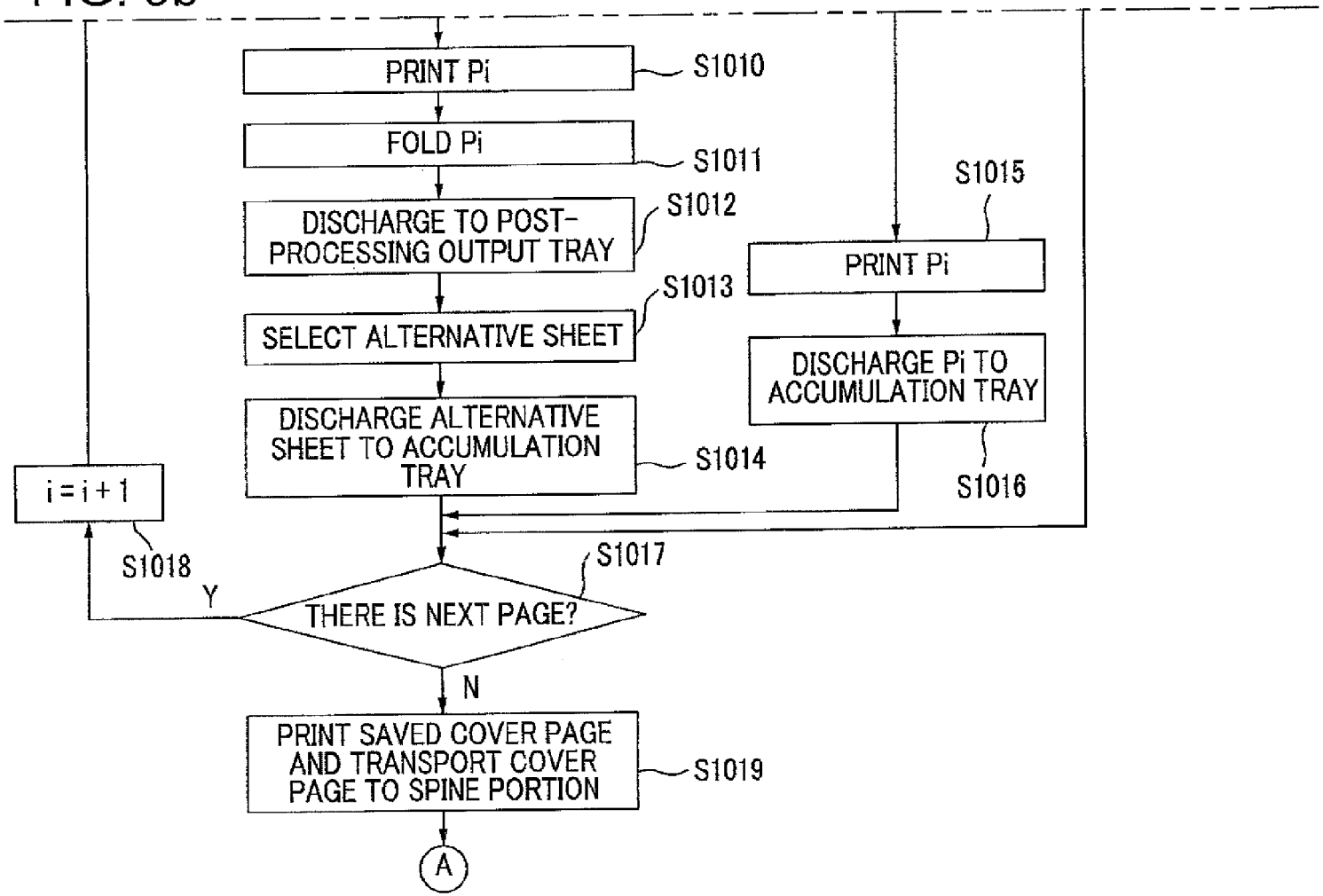

As shown in FIGS. 9(*a*) and 9(*b*), the printer 20 acquires a print job from the client device 10 (S1001), and analyzes the acquired print job (S1002). For example, the printer 20 may acquire information, such as the presence/absence of bookbinding designation of the print job, the attributes (cover, presence/absence of Z folding designation, printing size, and the like) of each page printed on the basis of the print job, and RIP data of each page.

When no bookbinding is designated in the print job (S1003: N), the printer 20 performs normal printing (S1004) and ends the process. When bookbinding is designated in the print job (S1003: Y), the printer 20 performs the following process.

The printer 20 selects a page Pi (where i is an integer of 1 to K, and the initial value of i is 1) which is printed on the basis of the print job (S1005), and when Pi is a cover (S1006: Y), saves Pi which is the cover page (S1007).

In S1006, when Pi is not a cover (S1006: N), and Pi is to be folded (S1009: Y), the printer 20 prints Pi (S1010), and transports the printed Pi to the post-processing device 40. The post-processing device 40 folds the transported Pi (S1011), and then discharges the folded Pi to the post-processing output tray 410 (S1012). The printer 20 selects an alternative sheet of Pi (S1013), and discharges the selected alternative sheet to the accumulation tray 310 of the bookbinding device 30 (S1014) using insertion unit 311.

In S1009, when Pi is not to be folding (S1009: N), the printer 20 prints Pi (S1015), and discharges the printed Pi to the accumulation tray 310 of the bookbinding device 30 (S1016).

After S1008, S1014, and S1016, the printer 20 determines whether or not there is a next page to Pi (that is, whether or not i=K) (S1017), when there is a next page (S1017: Y), increments i (S1018), returns to S1006, and repeats the process after S1006. In S1017, when there is no next page (S1017: N), the printer 20 prints the cover page saved in S1007, transports the cover page to the pasting unit 362 (S1019), and progresses the process to the flow of FIG. 10.

Figure 10:
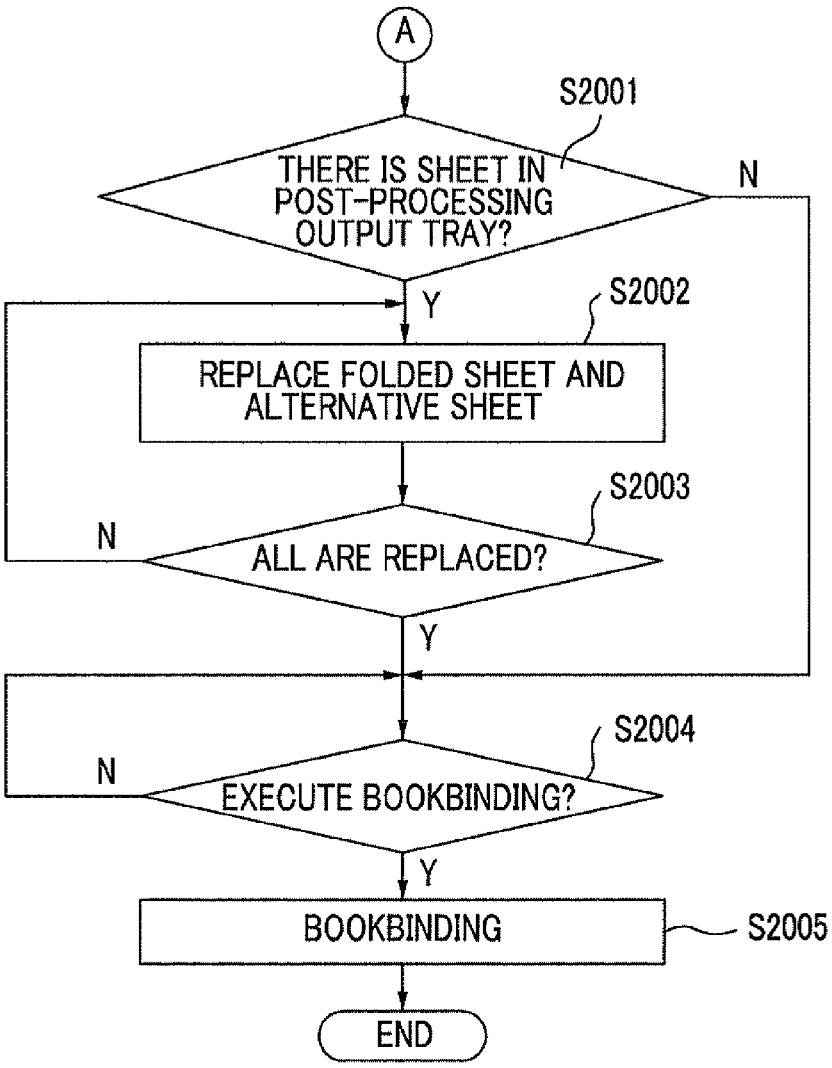
FIG. 10 is a flowchart illustrating the flow of bookbinding which is common to first and second examples.
Figure 11:
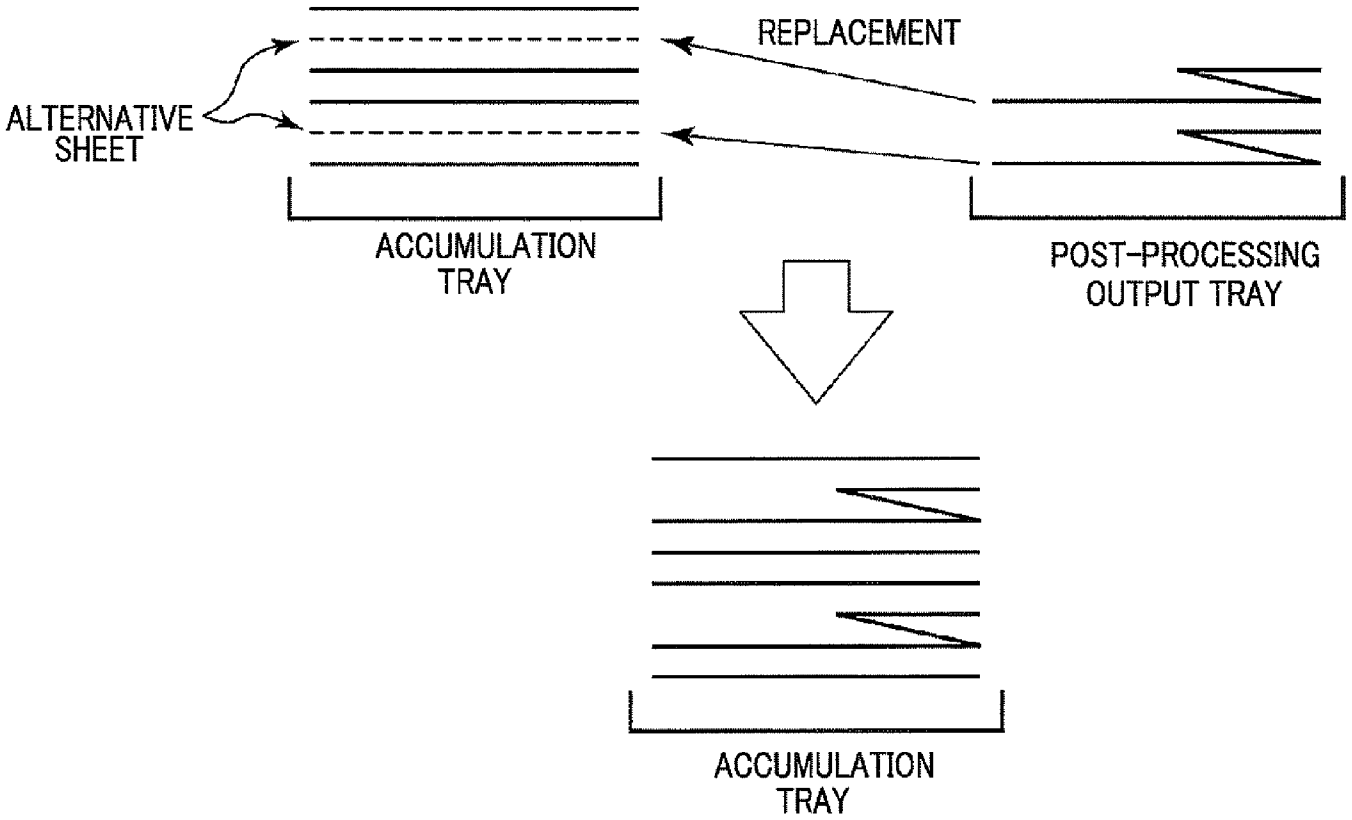
FIG. 11 is a diagram illustrating replacement processing of an alternative sheet.

As shown in FIG. 10, if there are sheets (folded sheet) discharged to the post-processing output tray 410 of the post-processing device 40 (S2001: Y), the user replaces sheets discharged to the post-processing output tray 410 with alternative sheets discharged to the accumulation tray 310 of the bookbinding device 30 (S2002). For example, as shown in FIG. 11, the sheets discharged to the post-processing output tray 410 may be replaced with the alternative sheets discharged to the accumulation tray 310 of the bookbinding device 30 on the basis of a combination where the order in which the sheets are discharged to the post-processing output tray 410 and the order in which the alternate sheets are discharged to the accumulation tray 310 of the bookbinding device 30 are aligned.

When all the sheets discharged to the post-processing output tray 410 of the post-processing device 40 are not replaced with the alternative sheet discharged to the accumulation tray 310 of the bookbinding device 30 (S2003: N), the user issues an instruction to perform the processing of S2002 until all sheets are replaced. When all sheets are replaced (S2003: Y), whether or not to perform bookbinding is inquired of the user (S2004). For example, the inquiry to the user may be made through a screen displayed on the operation panel unit 214 of the printer 20 to inquire about whether or not to perform bookbinding.

When an instruction to perform bookbinding is not input (S2004: N), waiting until an instruction is input is performed. When an instruction to perform bookbinding is input (S2004: Y), bookbinding is performed (S2005), and the process ends.

Although in the above-described process, the process when outputting one bound volume has been described, when outputting multiple volumes, the process after S1005 may be repeatedly performed for each volume.

Next, the flow of bookbinding according to a second example in the bookbinding system 1 will be described with reference to a flowchart shown in FIGS. 12(*a*)-12(*c*).

Figure 12A:
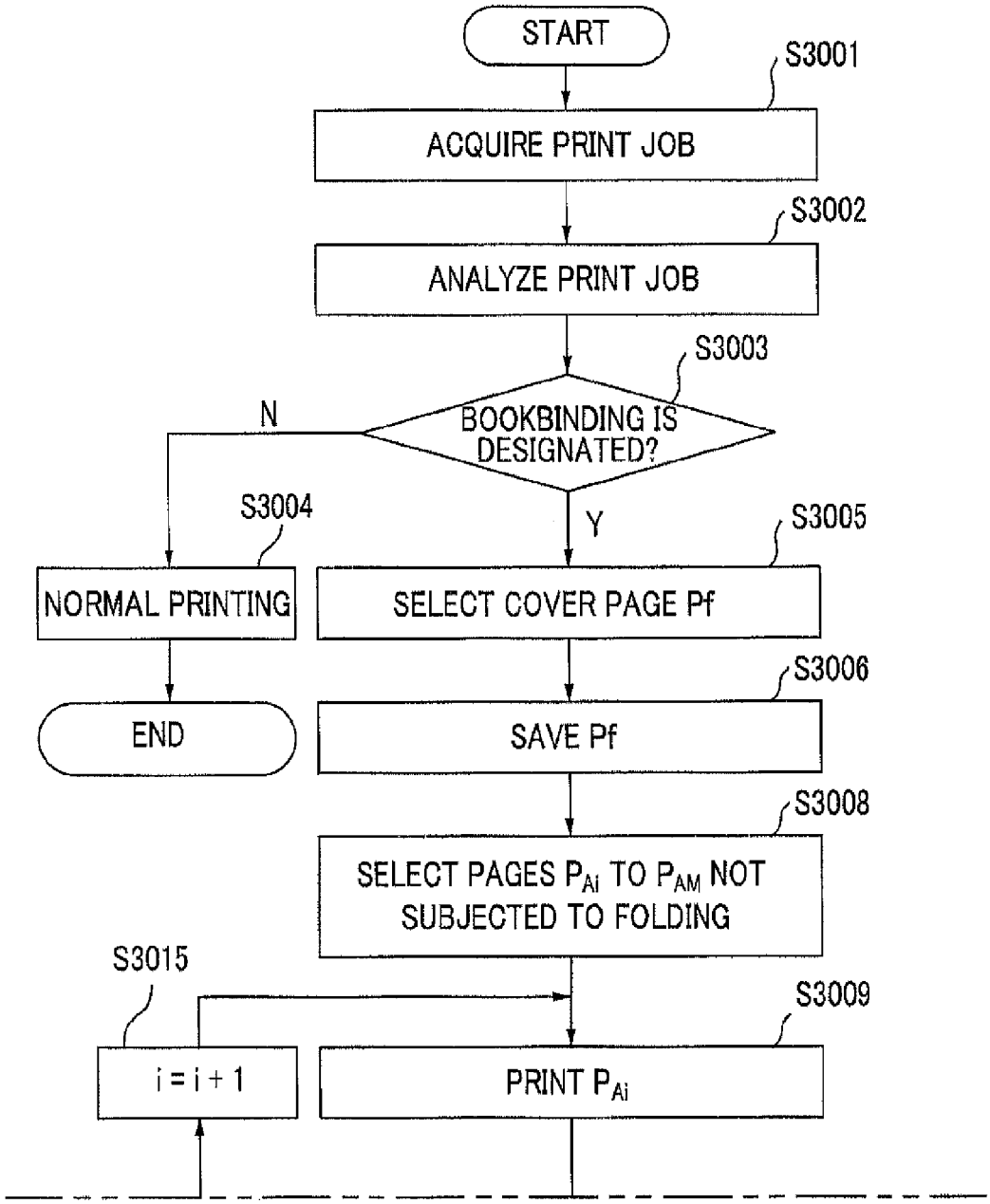
FIGS. 12(*a*), 12(*b*) and 12(*c*) are flowcharts illustrating the flow of bookbinding according to a second example.
Figure 12B:
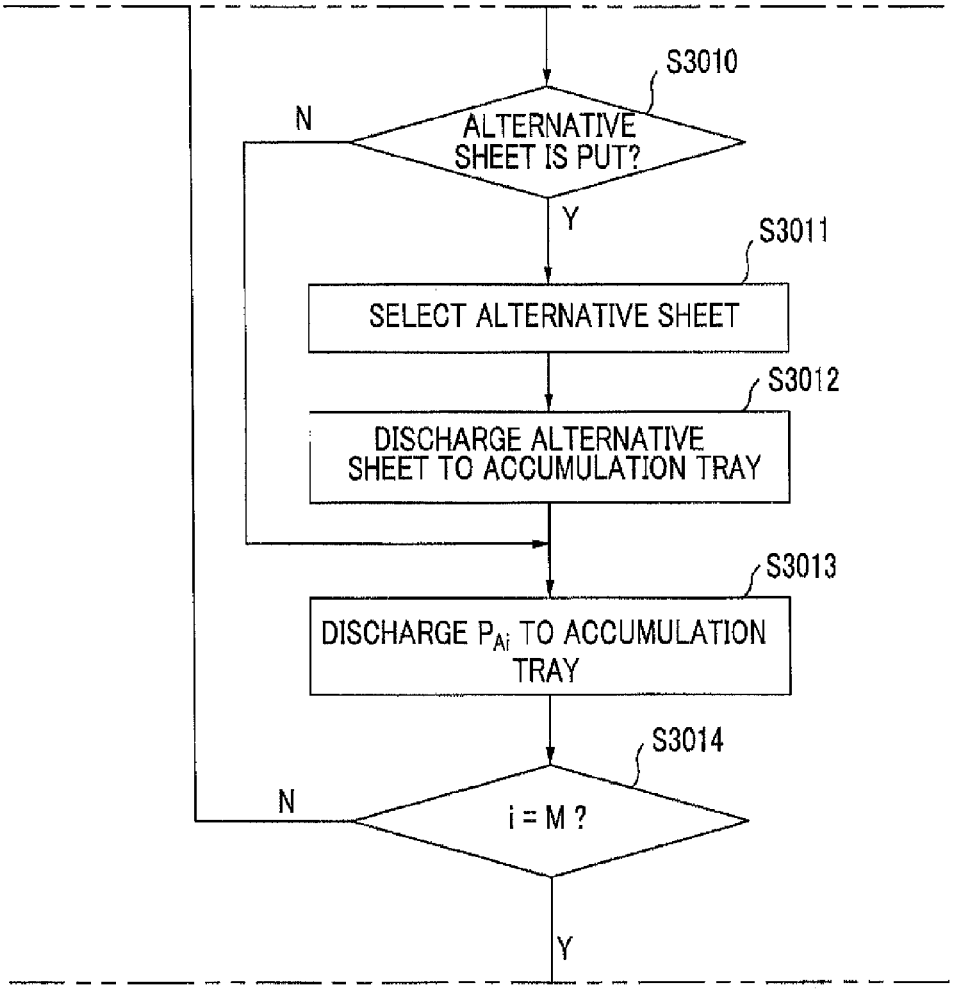
Figure 12C:
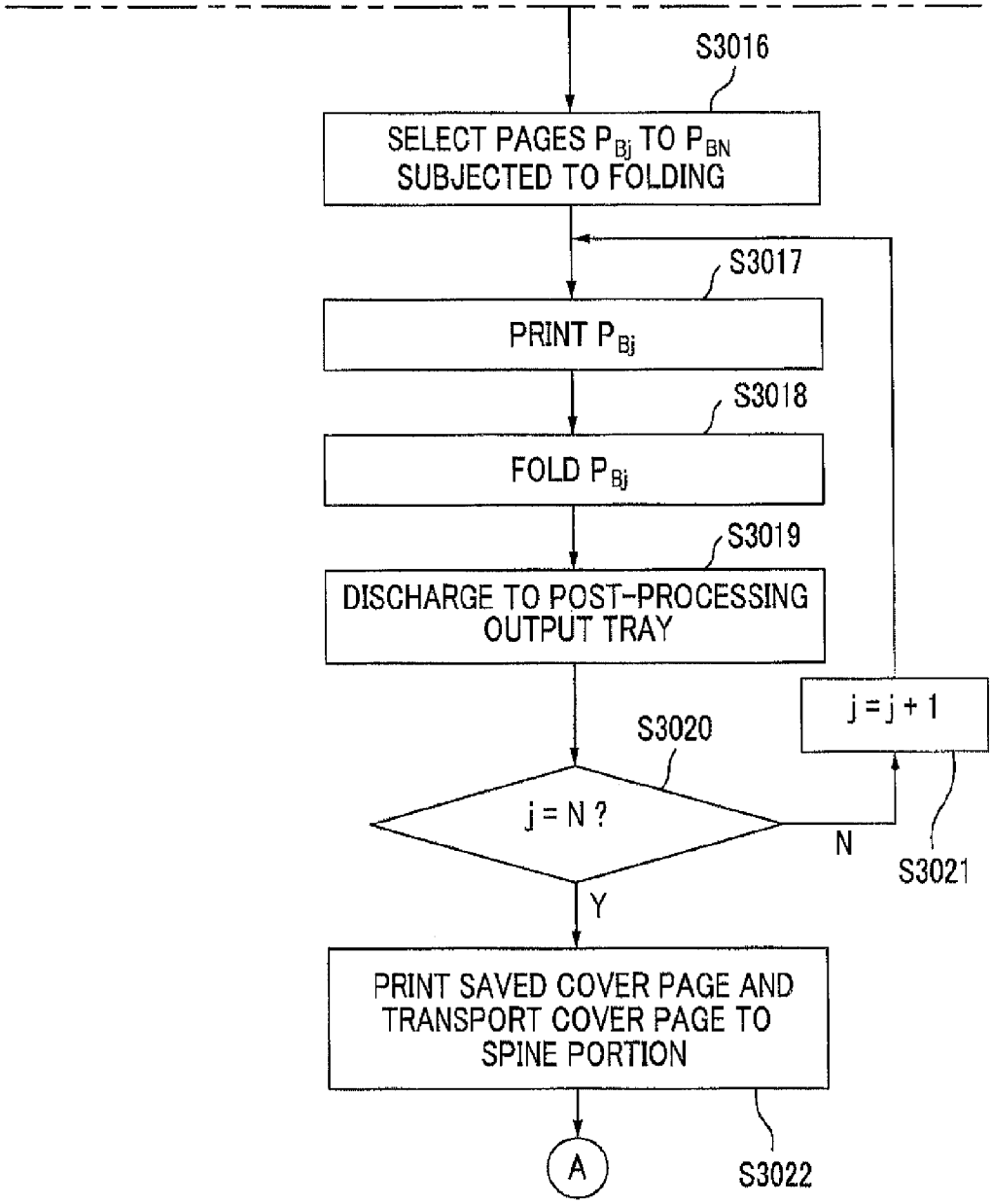

As shown in FIGS. 12(*a*)-12(*c*), the printer 20 acquires a print job from the client device 10 (S3001), and analyzes the acquired print job (S3002). For example, the printer 20 may acquire information, such as the presence/absence of bookbinding designation of the print job, the attribute (cover, presence/absence of Z folding designation, printing size, and the like) of each page printed on the basis of the print job, and rip data of each page.

When no bookbinding is designated in the print job (S3003: N), the printer 20 performs normal printing (S3004) and ends the process. When bookbinding is designated in the print job (S3003: Y), the printer 20 performs the following process.

The printer 20 selects a cover page Pf from among all pages which are printed on the basis of the print job (S3005), and saves the cover page Pf (S3006).

Next, the printer 20 selects folding-not-required pages $P_{A1}$ to $P_{AM}$ not to be folded from among all pages which are printed on the basis of the print job (S3008), and prints a folding-not-required page $P_{Ai}$ (where i is an integer of 1 to M, and the initial value of i is 1) (S3009). When an alternative sheet is put before $P_{Ai}$ (S3010: Y), the printer 20 selects the alternative sheet (S3011), discharges the selected alternative sheet to the accumulation tray 310 of the bookbinding device 30 (S3012), and then discharges the printed $P_{Ai}$ to the accumulation tray 310 (S3013).

When i has not reached M (that is, when a folding-not-required page remains) (S3014: N), the printer 20 increments i (S3015), returns to S3009, and repeats the process after S3009.

When i reaches M (that is, when no folding-not-required page remains) (S3014: Y), the printer 20 selects folding-required pages $P_{B1}$ to $P_{BN}$ to be folded from among all pages which are printed on the basis of the print job (S3016) The printer 20 prints a folding-required page $P_{Bj}$ (where j is an integer of 1 to N, and the initial value of j is 1) selected from among the folding-required pages $P_{B1}$ to $P_{BN}$ (S3017), and then transports the printed $P_{Bj}$ to the post-processing device 40. The post-processing device 40 folds the transported $P_{Bj}$ (S3018), and discharges the folded $P_{Bj}$ to the post-processing output tray 410 (S3019).

When j has not reached N (that is, when a folding-required page remains) (S3020: N), the printer 20 increments j (S3021), returns to S3017, and repeats the process after S3017. In S3020, when j reaches N (that is, when no folding-required page remains) (S3020: Y), the printer 20 prints the cover page saved in S3006, transports the cover page to the pasting unit 362 (S322), and progresses the process to the flow shown in FIG. 10. The flow shown in FIG. 10 is the same as in the first example, thus description thereof will not be repeated.

As in the first example, although in the above-described process, the process when outputting one bound volume has been described, when outputting multiple volumes, the process after S3005 may be repeatedly performed for each volume.

Next, the flow of bookbinding according to a third example in the bookbinding system 1 will be described with reference to a flowchart shown in FIGS. 13(*a*)-13(*c*).

Figure 13A:
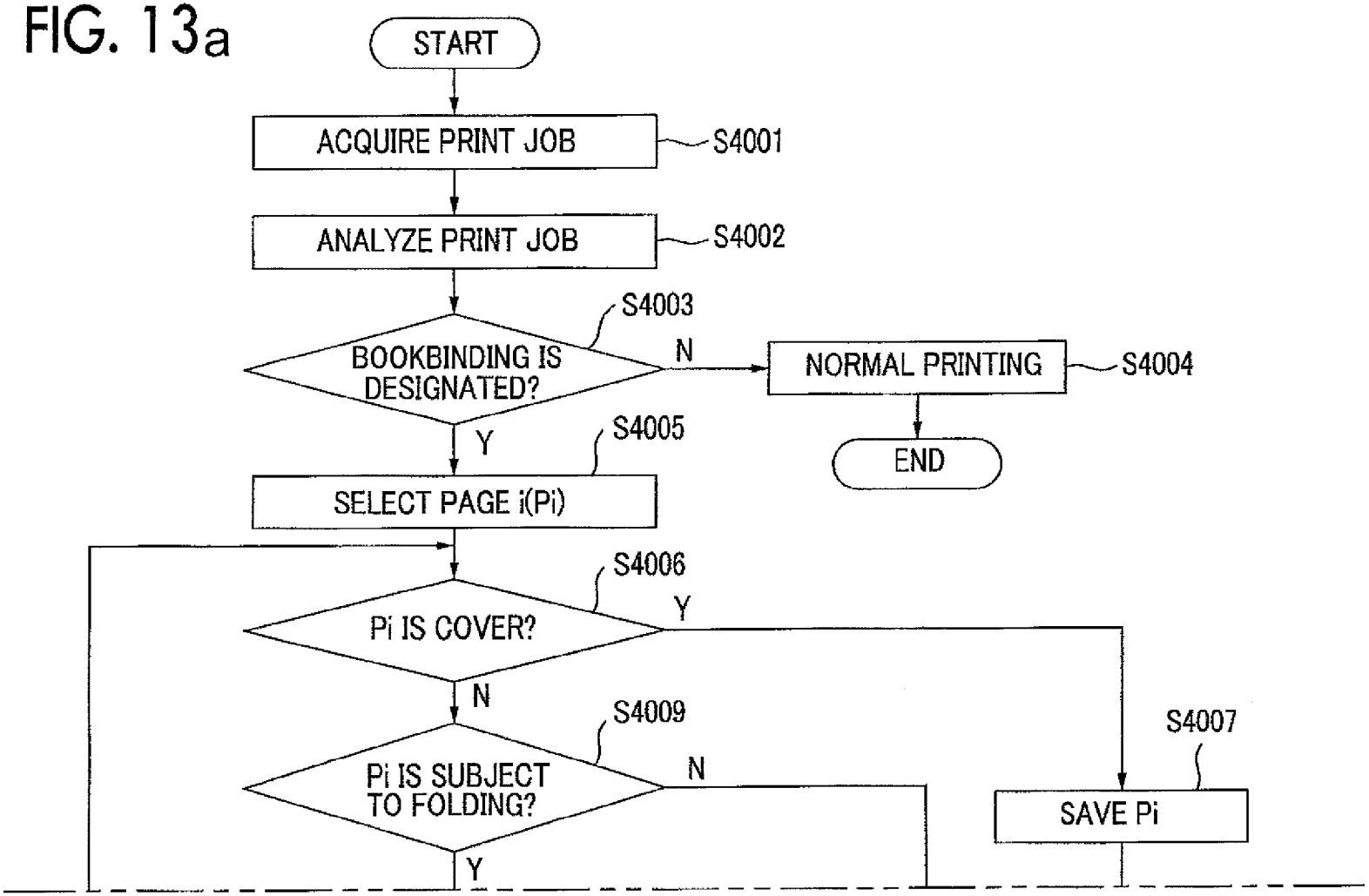
FIGS. 13(*a*), 13(*b*) and 13(*c*) are flowcharts illustrating the flow of bookbinding according to a third example.
Figure 13B:
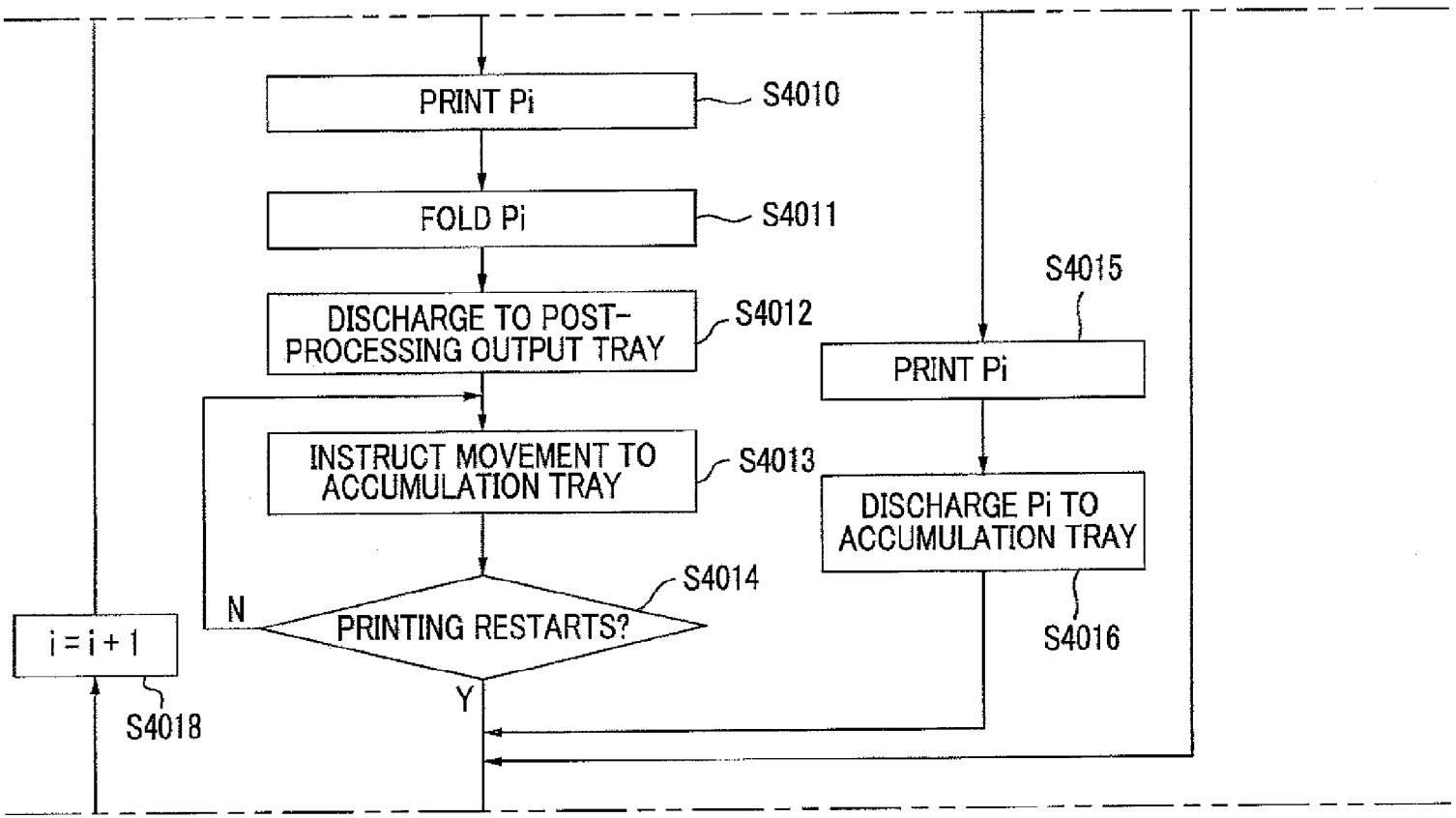
Figure 13C:
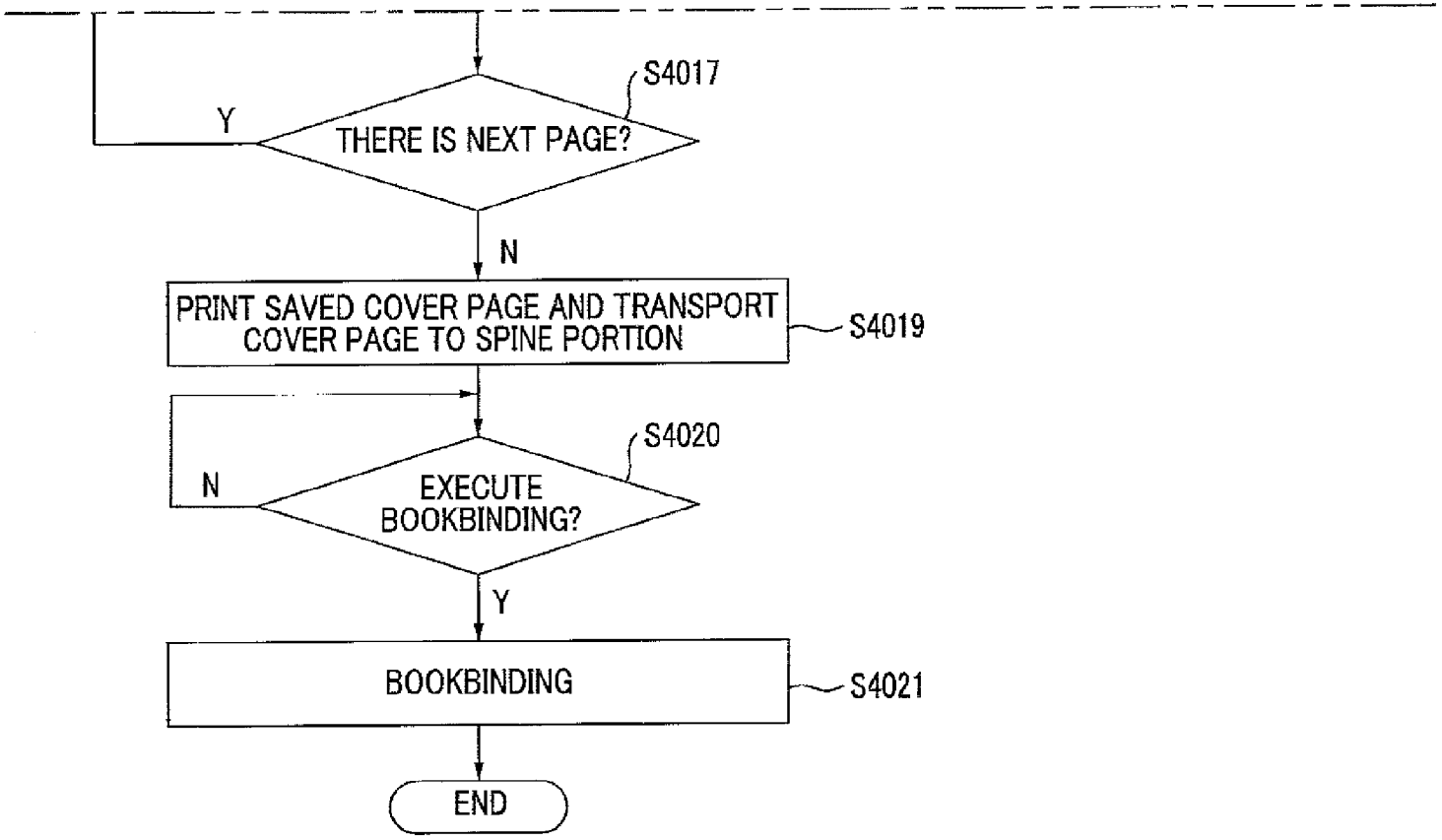

As shown in FIGS. 13(*a*)-13(*c*), the printer 20 acquires a print job from the client device 10 (S4001), and analyzes the acquired print job (S4002). For example, the printer 20 may acquire information, such as the presence/absence of bookbinding designation of the print job, the attributes (cover, presence/absence of Z folding designation, printing size, and the like) of each page printed on the basis of the print job, and rip data of each page.

When no bookbinding is designated in the print job (S4003: N), the printer 20 performs normal printing (S4004) and ends the process. When bookbinding is designated in the print job (S4003: Y), the printer 20 performs the following process.

The printer 20 selects a page Pi (where i is an integer of 1 to K, and the initial value of i is 1) which is printed on the basis of the print job (S4005), and when Pi is a cover (S4006: Y), saves Pi which is the cover page (S4007).

In S4006, when Pi is not a cover (S4006: N), and Pi is to be folded (S4009: Y), the printer 20 prints Pi (S4010), and transports the printed Pi to the post-processing device 40. The post-processing device 40 folds the transported Pi (S4011), and discharges the folded Pi to the post-processing output tray 410 (S4012). The printer 20 instructs the user to move Pi discharged to the post-processing output tray 410 to the accumulation tray 310 of the bookbinding device 30 (S4013), and inquires of the user about whether or not to restart printing (S4014). For example, the printer 20 displays a message of the effect "Please move the sheet discharged to the post-processing output tray 410 to the accumulation tray 310 and press a printing restart button" on the operation panel unit 214, waits while the printing restart button has not been pressed (S4014: N), and when the printing restart button is pressed (S4014: Y), progresses the process to S4017.

In S4009, when Pi is not to be folded (S4009: N), the printer 20 prints Pi (S4015) and discharges the printed Pi to the accumulation tray 310 of the bookbinding device 30 (S4016).

When the determination result in S4008 or S4014 is Y, after S4016, the printer 20 determines whether or not there is a next page to Pi (that is, whether or not i=K) (S4017). When there is a next page (S4017: Y), the printer 20 increments i (S4018), returns to S4006, and repeats the process after S4006.

In S4017, when there is no next page (S4017: N), the printer 20 prints the cover page saved in S4007 and transports the cover page to the pasting unit 362 (S4019). The printer inquires of the user about whether or not to perform bookbinding (S4020). For example, the inquiry to the user may be made through a screen displayed on the operation panel unit 214 of the printer 20 to inquire whether or not to perform bookbinding.

When no instruction to perform bookbinding is input (S4020: N), waiting until an instruction is input is performed. When an instruction to perform bookbinding is input (S4020: Y), bookbinding is performed (S4021), and the process ends.

Although in the above-described process, the process when outputting one bound volume has been described, when outputting multiple volumes, the process after S4005 may be repeatedly performed for each volume.

Next, an example of alternative sheets which are replaced between or before and after folding-not-required pages discharged to the accumulation tray 310 after having been printed by the printer 20 will be described with reference to FIGS. 14A to 14D.

Figure 14B:
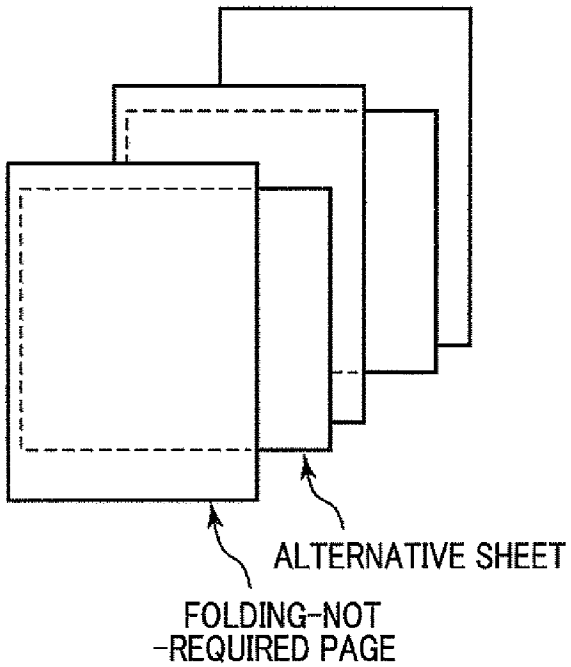
FIGS. 14A to 14D are diagrams illustrating an example of an alternative sheet.
Figure 14A:
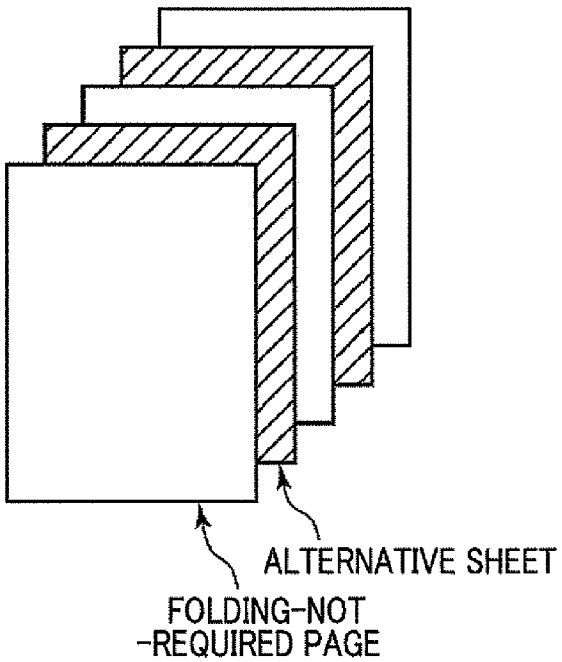

FIG. 14A shows an example where alternative sheets are sheets having colors different from folding-not-required pages. The alternative sheets may be sheets having the same color or sheets having different colors.

FIG. 14B shows an example where alternative sheets are sheets which are discharged in a direction different from folding-not-required pages. In the example shown in FIG. 14B, alternative sheets are discharged in a state of being rotated by 90 degrees with respect to the sheets of folding-not-required pages.

Figure 14D:
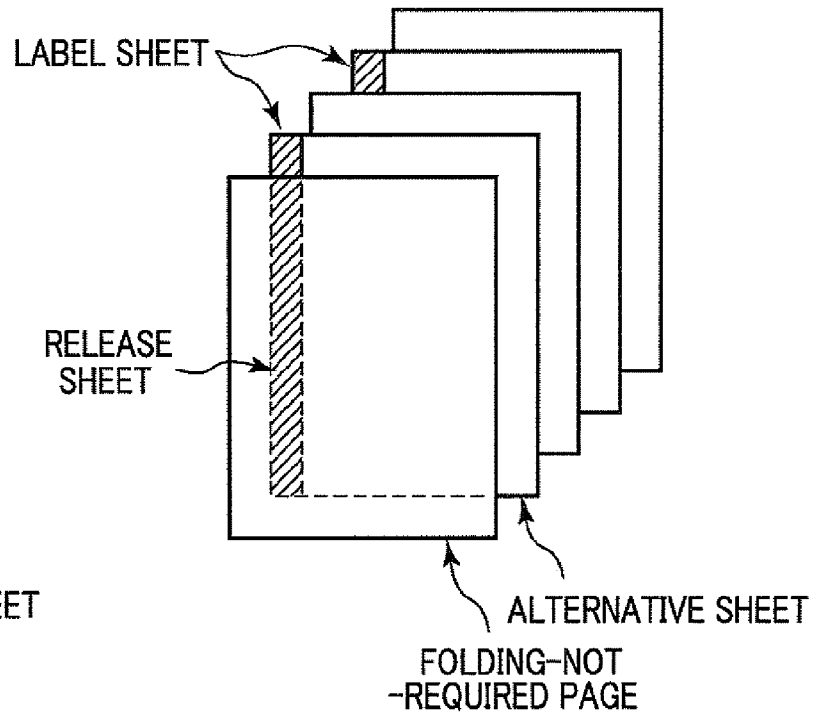
Figure 14C:
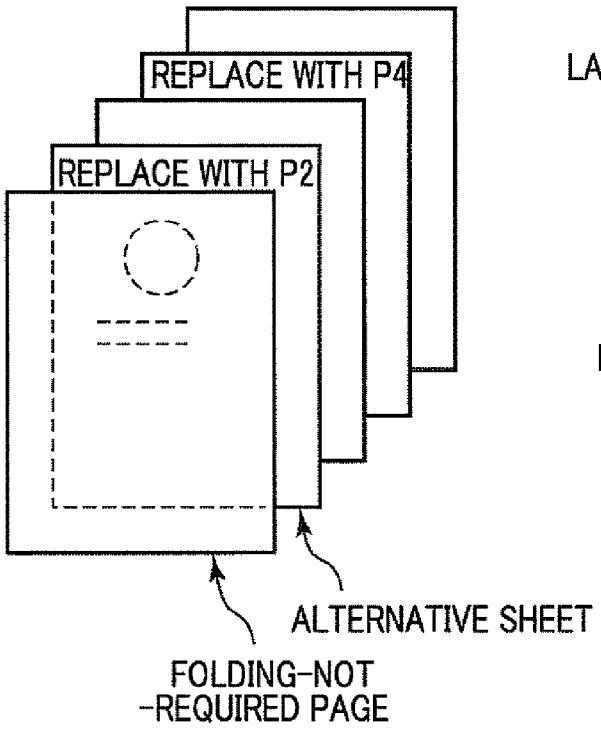

FIG. 14C shows an example where alternative sheets are sheets on which specific information for specifying folding-required pages to be replaced is formed. For example, specific information which is formed on alternative sheets may be information relating to at least a part of an image formed on a folding-required page to be replaced, or the page number of a folding-required page, or the like. In this case, the printer 20 may select an alternative sheet, may then print specific information of a folding-required page to be replaced with the alternative sheet, and may subsequently discharge the alternative sheet to the accumulation tray 310.

FIG. 14D shows an example where alternative sheets are label sheets in which an adhesive portion (seal portion) at an end is covered with release paper. In this case, the release paper of an alternative sheet may be removed, and a corresponding folding-required page may be adhered to the adhesive portion. As the label sheets, label sheets (label sheet type A) in which release paper is provided at the left end thereof and label sheets (label sheet type B) in which release paper is provided at the right end thereof may be prepared, and the label sheet type A or the label sheet type B may be selected depending on the direction (left-side bound or right-side bound) of Z folding.

The invention is not limited to the foregoing exemplary embodiment. For example, although in the foregoing exemplary embodiment, an example where the transport paths are connected in order of the printer 20, the bookbinding device 30, and the post-processing device 40 has been described, the transport paths may be connected in order of the printer 20, the post-processing device 40, and the bookbinding device 30, or other devices (a sheet feeding device, a punching device, a stapling device, a trimming device, and the like) may be connected between or before and after the printer 20, the bookbinding device 30, and the post-processing device 40.

Although in this exemplary embodiment, an example where the invention is applied to when post-processing is Z folding has been described, the invention may be applied similarly to other kinds of processing in which a sheet after post-processing is unable to be transported directly to the bookbinding device 30.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A bookbinding control device comprising: an acquisition unit that acquires print data including post-processing-not-required pages requiring no post-processing after printing and before bookbinding and post-processing-required pages requiring post-processing; a first accumulation controller that performs control so as to accumulate sheets with the printed post-processing-not-requires pages based on print data in a first accumulation unit; an insertion unit that inserts alternative sheets representing the positions of sheets, on which post-processing-required pages are to be disposed on the basis of print data, between the sheets with the printed post-processing-not-required pages on the basis of print data in the first accumulation unit; and wherein the post-processing required pages subjected to the post-processing are accumulated in a second accumulation unit different from the first accumulation unit, the post-processing-required pages being ordered to replace the alternative sheets in the first accumulation unit; and a bookbinding controller that performs control so as to perform bookbinding after the sheets with the printed post-processing-not-required pages in the first accumulation unit and the post-processing-required pages subjected to the post-processing based on the print data in the second accumulation unit are combined in an accumulation tray and after the controller displays a screen inquiring whether or not bookbinding is to be performed in a prescribed order.

2. The bookbinding control device according to claim 1, further comprising:

an insertion unit that inserts alternative sheets representing the positions of sheets, on which post-processing-required pages are to be disposed on the basis of print data, between the sheets with the printed post-processing-not-required pages on the basis of print data in the first accumulation unit.

3. The bookbinding control device according to claim 1, further comprising:

a printing controller that performs control so as to pause printing when the post-processing-required pages are printed on the basis of print data and restarts printing after the sheets with the printed post-processing-required pages are accumulated in the first accumulation unit.

4. A non-transitory computer readable medium storing a program causing a processor to function as:

an acquisition unit that acquires print data including post-processing-not-requires pages requiring no post-processing after printing and before bookbinding and post-processing-requires pages requiring post-processing;

a first accumulation controller that performs control so as to accumulate sheets with the printed post-processing-not-required pages based on print data in a first accumulation unit;

an insertion unit that inserts alternative sheets representing the positions of sheets, on which post-processing-required pages are to be disposed on the basis of print data, between the sheets with the printed post-processing-not-required pages on the basis of print data in the first accumulation unit; and wherein the post-processing required pages subjected to the post-processing are accumulated in a second accumulation unit different from the first accumulation unit, the post-processing-required pages being ordered to replace the alternative sheets in the first accumulation unit; and a bookbinding controller that performs control so as to perform bookbinding after the sheets with the printed post-processing-not-required pages in the first accumulation unit and the post-processing-required pages subject to the post-processing based on the print data in the second accumulation unit are combined in an accumulation tray and after the controller displays a screen inquiring whether or not bookbinding is to be performed in a prescribed order.

5. A bookbinding system comprising:

a printer;

a bookbinding device; and a post-processing device, wherein the printer includes a printing unit that acquires and prints print data including post-processing-not-required pages requiring no post-processing after printing and before bookbinding and post-processing-required pages requiring post-processing, the bookbinding device includes a first accumulation unit that accumulates the sheet with the printed post-processing-not-required page based on print data, and an insertion unit that inserts alternative sheets representing the positions of sheets, on which post-processing-required-pages are to be disposed on the basis of print data, between the sheets with the printed post-processing-not-required pages on the basis of print data in the first accumulation unit, wherein the post-processing-required pages subjected to the post-processing are accumulated in a second accumulation unit different from the first accumulation unit, the post-processing-required pages being ordered to replace the alternative sheets in the first accumulation unit; and the post-processing device includes a post-processing unit that performs the post-processing on the sheet with the printed post-processing-required page based on print data, and the bookbinding device further includes a bookbinding unit that performs bookbinding after the sheets with the printed post-processing-not-required pages in the first accumulation unit and the post-processing-required pages subject to the post-processing based on the print data in the second accumulation unit are combined in an accumulation tray and after the controller displays a screen inquiring whether or not bookbinding is to be performed in a prescribed order.

6. A method of controlling bookbinding, the method comprising:

acquiring print data including post-processing-not-required pages requiring no post-processing after printing and before bookbinding and post-processing-required pages requiring post-processing;

performing control so as to accumulate sheets with the printed post-processing-not-required pages based on print data in a first accumulation unit;

performing control so as to insert alternative sheets representing the positions of sheets, on which post-processing-required pages are to be disposed on the basis of print data, between the sheets with the printed post-processing-not-required pages on the basis of print data in the first accumulation unit; and wherein the post-processing required pages subjected to the post-processing are accumulated in a second accumulation unit different from the first accumulation unit, the post-processing-required pages being ordered to replace the alternative sheets in the first accumulation unit; and performing control so as to perform bookbinding after the sheets with the printed post-processing-not-required pages in the first accumulation unit and the post-processing-required pages subject to the post-processing based on the print data in the second accumulation unit are combined in an accumulation tray and after the controller displays a screen inquiring whether or not bookbinding is to be performed in a prescribed order.

* * * * *